United States Patent [19]

Coleman

[11] 4,067,572

[45] Jan. 10, 1978

[54] GOLF CLUB

[76] Inventor: Marvin W. Coleman, 10607 Moore St., Fairfax, Va. 22030

[21] Appl. No.: 711,960

[22] Filed: Aug. 5, 1976

[51] Int. Cl.[2] ..... A63B 53/06

[52] U.S. Cl. ..... 273/79; 273/167 J; 273/171; 273/173; 273/175

[58] Field of Search ..... 273/77 R, 79, 80.1, 273/162 R, 167 R, 167 C, 167 F, 169, 171, 173, 175

[56] References Cited

U.S. PATENT DOCUMENTS

| | | | |
|---|---|---|---|
| 1,064,916 | 6/1913 | Kelly et al. | 273/167 C X |
| 1,352,020 | 9/1920 | Olson | 273/79 |
| 1,665,523 | 4/1928 | Boyce | 273/79 |
| 1,695,598 | 12/1928 | MacClain | 273/175 |
| 2,138,294 | 11/1938 | Douglas | 273/79 |
| 2,325,525 | 7/1943 | Lukenbill | 273/79 X |
| 3,190,651 | 6/1965 | Thomas | 273/79 |
| 3,260,525 | 7/1966 | Ortel | 273/175 X |

FOREIGN PATENT DOCUMENTS

| | | | |
|---|---|---|---|
| 591,595 | 8/1947 | United Kingdom | 273/79 |

*Primary Examiner*—Richard J. Apley
*Attorney, Agent, or Firm*—Shlesinger, Arkwright, Garvey & Dinsmore

[57] ABSTRACT

A golf club having a shaft and a club head, the club head comprising a stationary, main body portion, and a face portion which is movable with respect to the stationary portion to vary the angular disposition of the face portion with respect to the stationary portion and the shaft of the club.

18 Claims, 11 Drawing Figures

GOLF CLUB

BACKGROUND OF THE INVENTION

Golf clubs, and particularly woods, have been custom made for years in order to provide the golfer with clubs which are best suited for his size, strength, etc. Custom fitting involves modification to the clubs of standard shape by means of variations in the shaft, the hand grip and the club head. The golfer is thereby aided to a certain extent, but such custom made clubs will not compensate for defects in the golfer's swing which cause the golf ball to hook, slice, etc.

There have been attempts in the past to modify the heads of golf clubs by providing an adjustable striking face, such as illustrated in U.S. Pat. Nos. 1,655,523, 2,026,749 and 2,175,598. However, the adjustment features disclosed in these patents relate to adjustment of the club face in a vertical plane which, consequently, affects only the loft of the ball and does not materially aid in controlling the direction of flight of the ball.

SUMMARY OF THE INVENTION

The golf club of the present invention comprises a shaft which is attached to a club head which includes a stationary main body portion and a movable face portion which is adjustably engaged with the stationary portion to permit adaptation of the golf club to the swing of a particular individual.

The main body portion of the golf club is preferably of spherical or the like, hollow construction, and diametrically opposed sides of the main body portion are cut away. The movable face portion of the golf club is complemental to the main body portion and is engaged therewith in the area of the cut away section, where it is held in place by a clamping member engaged with the opposite face of the stationary portion also located proximate a cut away section. The clamping member and club face portion are connected by a bolt member.

By loosening the bolt member, the club face portion may be repositioned through an arc of 360° and fixed in the desired position by tightening the bolt member. Weight is readily added to the hollow stationary portion of the club head as desired.

DESCRIPTION OF FORM OF INVENTION ILLUSTRATED IN FIGURES 1 TO 5

Figure 1:
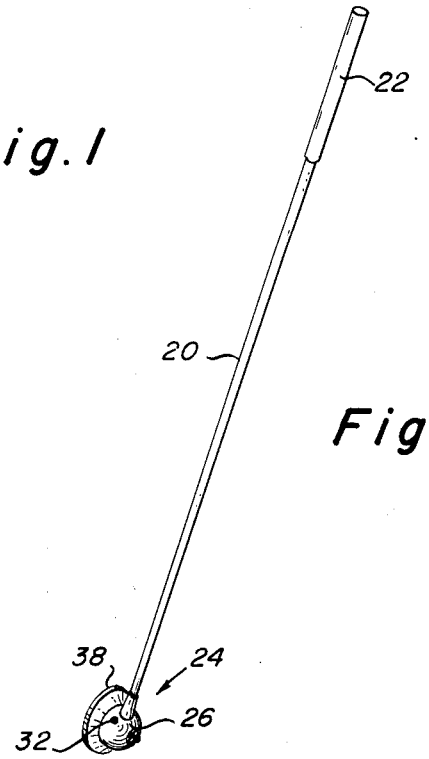
FIG. 1 is a perspective view of a golf club contructed in accordance with the present invention.
Figure 2:
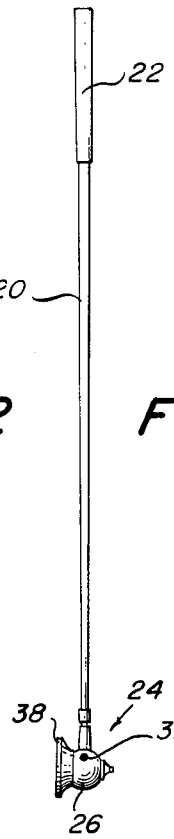
FIG. 2 is a side elevational view of the same.

In FIGS. 1 to 5, there is illustrated a golf club constructed in accordance with the present invention which includes a shaft 20 having a hand grip 22 at one end thereof and a club head generally designated 24 at the opposite end thereof.

Club head 24 includes a stationary body portion 26 which is spherical in shape and is provided with a stem 28 which stem has a longitudinal bore adapted to receive and hold one end of shaft 20.

Main body 26 is hollow, thereby providing a chamber 30 into which liquid or granular weighting material 31 may be placed through a suitable access member 32 removably inserted in the wall of body portion 26. As shown to advantage in FIG. 4, the diametrically opposed walls of spherical main body portion 26 are provided with substantial cut away sections 34 and 36.

It is a salient feature of the present invention to provide a multi-piece club head, which includes a movable face portion of disc-like conformation adapted for engagement with main body portion 26. Face portion 38 is preferably made of nylon, lexan, phenolic fiber, metal or other suitable hard material.

Figure 3:
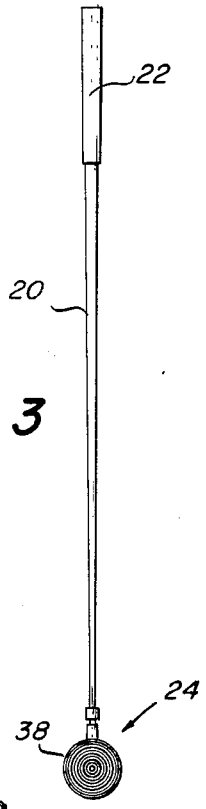
FIG. 3 is a front elevational view of the same.
Figure 4:
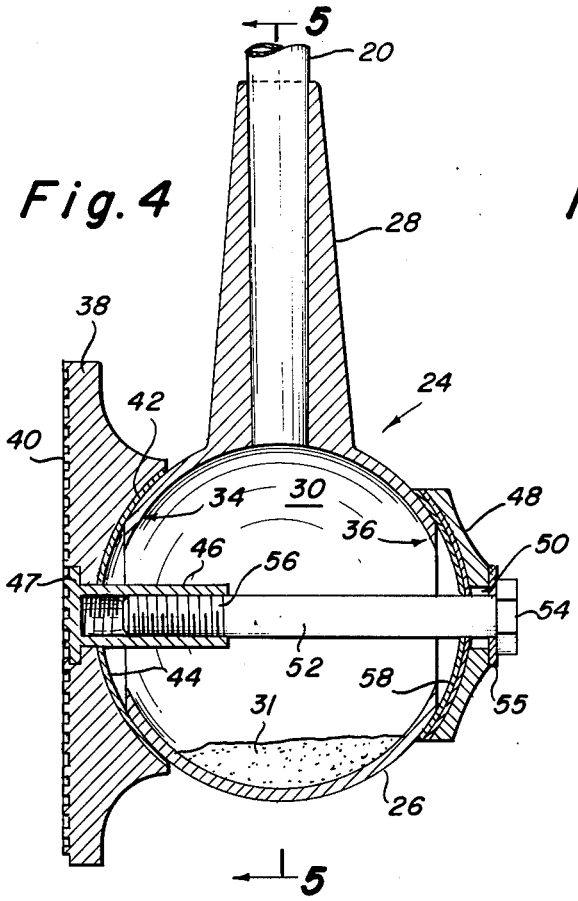
FIG. 4 is an enlarged sectional view of a club head constructed in accordance with the present invention.
Figure 5:
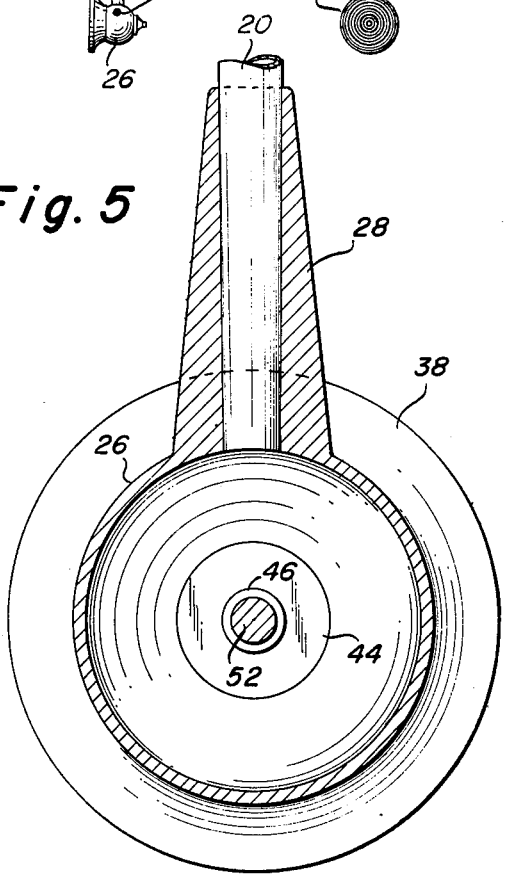
FIG. 5 is a view taken along the line 5—5 of FIG. 4, looking in the direction of the arrows.

Face portion 38 includes a ball-engaging front part 40 and a rear part 42, a portion of which is contoured to complement that portion of main body portion 26 adjacent cut away section 34. As shown in FIG. 3, front part 40 may be provided with a series of concentric annular grooves for improved ball control.

An abrasive member 44 is interposed between movable face portion 38 and main body portion 26 to prevent accidental movement between these parts. A tubular stud 46 having an internally threaded bore extends through the central part of movable face portion 38. One end of tubular stud 46 is provided with a head 47 of hexagonal or other suitable shape, which is adhesively secured in a counterbore in front part 40 so that the outer face of the head lies flush with ball-engaging front part 40.

In association with movable face portion 38 there is provided a clamping member 48 of general concavo-convex shape which complements, and is adapted to engage, the convex portion of spherical main body portion 26. Clamping member 48 is provided with a central aperture 50 through which a retaining bolt 52 is inserted, the bolt having a head 54, and washer 55 at one end, and a threaded shaft 56 at the opposite end. Threaded shaft 56 is adapted to engage the threads of stud 46 for drawing clamping member 48 and movable face of stud 46 for drawing clamping member 48 and movable face portion 38 into light engagement with spherical main body portion 26. An abrasive member 58 inserted between clamping member 48 and the wall of main body portion 28 serves to prevent relative movement between these parts after the bolt has been tightened. If desired, abrasive members 44 and 58 may be permanently affixed either to main body portion 26 or to removable face portion 38 and clamping member 48.

It will be noted from a consideration of the drawings that the diameter of disc-like removable face portion 38 is substantially larger than that of main body portion 26 so that, in actual use, only the lower edge of front face portion 38 engages the ground, thereby creating less drag on the club when it is swung proximate to the ground.

In adapting the golf club of the present invention for use by the individual golfer, movable face portion 38 is first positioned in normal relationship to main body portion 26, as shown in full lines in FIGS. 1 to 5. The golfer practices with the club in this position in order to determine whether or not the ball is being hit straight and at the desired height from the ground. If the ball is hooking, slicing, or the trajectory of the ball is too high or too low, then bolt 54 is loosened in order to permit adjustment of front face portion 38 in any direction through a 360° arc. Bolt 54 is retightened and the golfer then hits additional practice shots in order to determine whether or not repositioning of front face portion 38 has corrected or partially corrected the problem, resulting in straighter drives at the proper height.

The repositioning step may be repeated, until the golfer feels that the golf club has been adjusted for his particular swing and that more perfect drives are being hit.

If it is determined that the club head is too light for the golfer, then weighting material 31 may be admitted to the interior of main body portion 26 by removing access member 32 and pouring the weighting material therein. The weighting material may consist of liquid, granular or solid materials of different specific gravities in order to have the desired weight, sand and shot being recommended material.

DESCRIPTION OF FORM OF INVENTION ILLUSTRATED IN FIGS. 6 THROUGH 8

Figure 6:
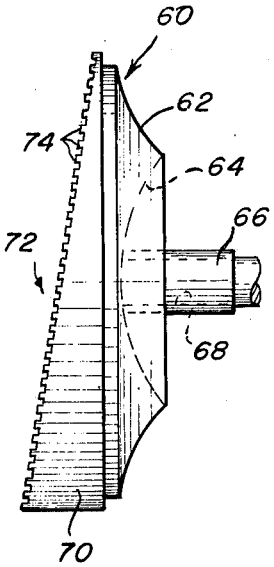
FIG. 6 is a side elevational view of a modified form of the face portion constructed in accordance with this invention.
Figure 7:
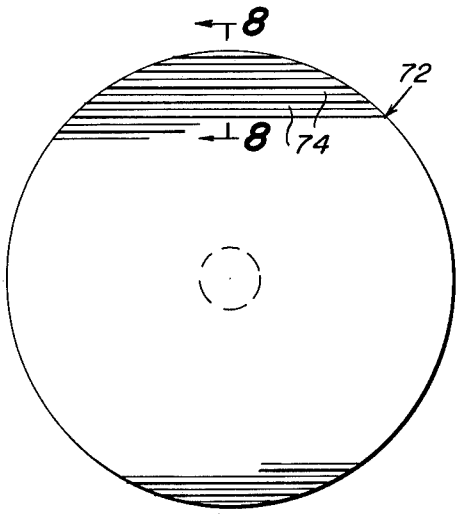
FIG. 7 is a front, elevational view of the face portion of FIG. 6.
Figure 8:
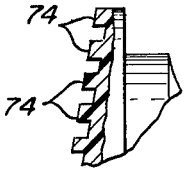
FIG. 8 is a sectional view taken along the line 8—8 of FIG. 7, looking in the direction of the arrows.

In FIGS. 6, 7 and 8, there is illustrated a modified form of movable face portion generally designated 60. Face portion 60 includes a substantially disc-like body 62, the rear face of which is concave as indicated at 64 for slideable engagement over a complemental part of the main body portion of the golf club. A stud 66 having an internally threaded bore 68 is fixedly secured to the concave face 64 of face 60 as shown to advantage in FIG. 6.

Face 60 further includes a ball-engaging disc portion 70 which is of wedge-like conformation in cross-section, which disc portion is fixedly secured to the front face of disc-like body 62.

Disc portion 64 is provided with a ball-engaging face 72, which face is provided with a plurality of transverse, parallel ribs 74. Ribs 74 form a non-slip tread which enables the golfer to effect spinning of the ball off the face of the club, the direction of which spin gyroscopically holds the ball in a truer line of flight that would otherwise be possible. By rotating the face of the club with respect to the stationary main body portion thereof, the angle of the rib lines may be varied to suit the golfer.

DESCRIPTION OF FORM OF INVENTION ILLUSTRATED IN FIGS. 9 AND 10

Figure 9:
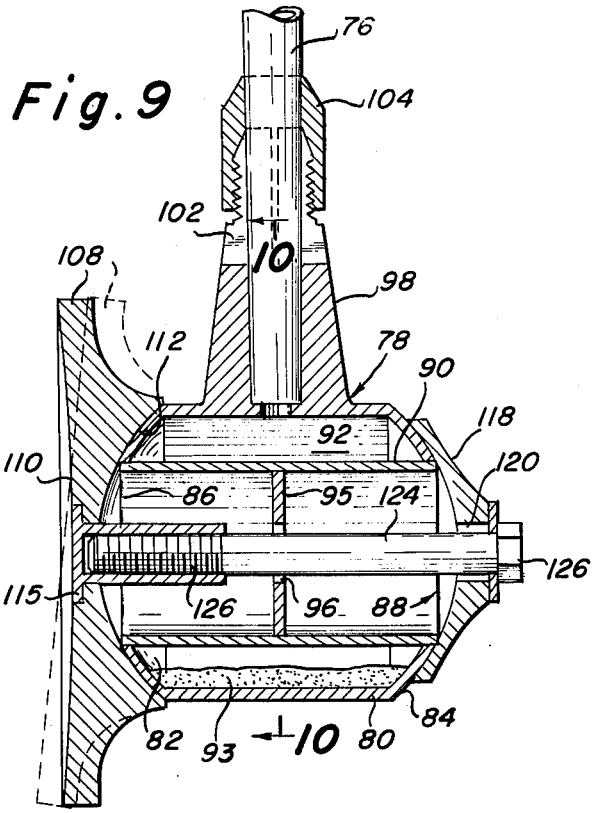
FIG. 9 is a sectional view taken through the club head of the modified form of the present invention.
Figure 10:
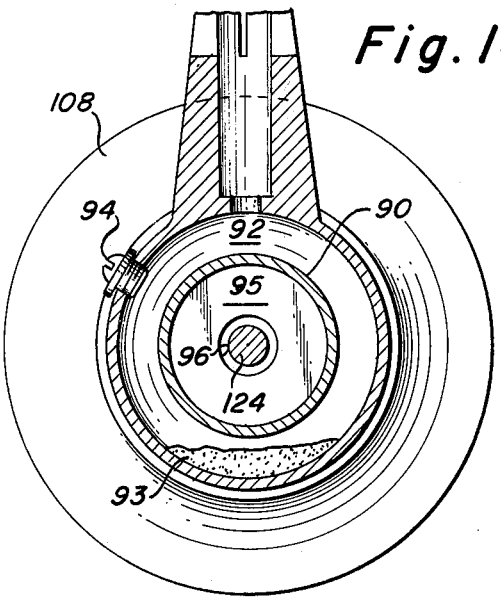
FIG. 10 is a section view taken along the line 10—10 of FIG. 9, looking in the direction of the arrow.

In FIGS. 9 and 10, there is illustrated a further modified form of the present invention wherein the club shaft is indicated at 76 and the club head at 78. Club head 78 includes a stationary, cylindrical main body portion 80, the ends of which issue into annular wall portions 82 and 84 which are curvilinear to provide an outer convex surface. Walls 82 and 84 have enlarged central openings 86 and 88 through which a tubular member 90 is inserted so that part of wall portions 82 and 84 defining openings 86 and 88 are fixedly engaged with the ends of tubular member 90. This forms a closed annular chamber 92 in main body portion 80 into which a weighting material 93, such as sand or shot may be inserted by removal of access member 94 located in the outer wall of main body portion 80. A wall 95 extends transversely of the central member 90 shown in FIG. 9, and is provided with an enlarged axial opening 96 for purposes to be hereinafter more fully set out.

A stem 98 issues from the outer periphery of main body portion 80 and is provided with a socket adapted to receive an end of shaft 76. In order to permit use of various types and lengths of shafts, shaft 76 is removably secured to head 78 by splining stem 98 as indicated at 100 and threading the outer terminal of stem 98 as indicated at 102 for threaded engagement with a retaining member 104 when engaged with stem 98 as shown in FIG. 9, member 104 securely holds the shaft 76 in place.

Just as in the form of invention illustrated in FIGS. 1 to 5, movable face portion 108 comprises a ball-engaging front face 110 which, as illustrated, is of disc-like conformation in order to effect better control of the direction in which the ball is hit. The rear face of face portion 108 is concave as indicated at 112 for sliding engagement over arcuate wall portion 82. A stud 114 extends centrally through movable portion 108, one end of which stud has a hexagonal head 115 which is adhesively secured. An abrasive member 116 is interposed between arcuate wall portion 82 and concave portion rear face 112 just as in the form of invention illustrated in FIGS. 1 to 5.

In connection with movable face portion 108, there is provided a clamping member 118 which is of generally concavo-convex conformation and provided with a central aperture 120. The inner concave face of clamping member 118 is adapted for sliding engagement with arcuate wall portion 84. An abrasive member 122 is interposed between clamping member 118 and arcuate wall portion 84 in order to prevent accidental relative movement between the clamping member and main body portion 80.

A bolt 124 is inserted through central aperture 120 of clamping member 118 and axial opening 96 of wall 94, the inner terminal of the bolt being threaded at 126 for engagement with the complementally threaded portion 114. Therefore, as bolt 124 is tightened, movable face portion 108 and clamping member 118 are retained against relative movement with respect to stationary body portion 80.

In this form of the invention, the procedure for adjustment of movable face portion 108 is substantially the same in connection with the form of invention illustrated in FIGS. 1 to 5, it being noted that enlarged axial opening 96 in wall 94 serves to limit and control the adjustment of bolt 124, with corresponding limitations on the movement of movable face portion 108.

DESCRIPTION OF FORM OF INVENTION ILLUSTRATED IN FIG. 11

Figure 11:
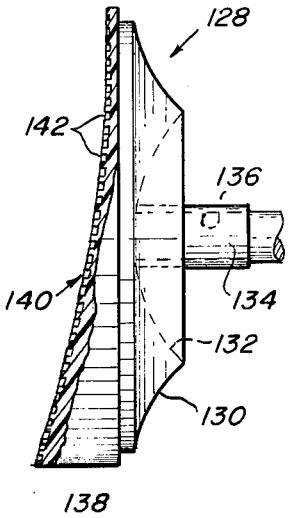
FIG. 11 is a side elevational view of a modified form of the face portion constructed in accordance with this invention.

In FIG. 11, there is illustrated a further modified form of an adjustable face portion which is generally designated 128. Face portion 128 includes a disc-like body 130, the rear face of which is concave as indicated at 132 for slideable engagement over a complemental part of the golf club main body portion. A stud 134 having an internally threaded bore 136 is centrally secured to concave face 132 of face 128.

Adjustable face portion 128 further includes a disc portion 138 of wedge-like conformation in cross section which is fixedly secured to the front face of disc-like body 130. Disc portion 138 includes a ball-engaging surface 140 having a plurality of concentric, annular grooves 142 arranged similar to that shown in FIG. 3. As will be noted from a consideration of FIG. 11, ball-engaging surface 140 is not flat, as in the form of invention shown in FIG. 6, but is concave or curved inwardy from the bottom of disc portion 138 to a point near the upper limit thereof.

By virtue of the curved ball-engaging face, the ball is centered on the sweet spot of the club head and the curvature of the face prevents the ball from flattening out as much as when a ball is struck by a golf club having a flat or convex face. Also, with the present concavely curved ball-engaging surface, the ball leaves the club face with little or no spin and the resulting shot is straight, thereby resulting in better control than has heretofore been possible with conventional clubs.

By providing a ball-engaging surface having a plurality of concentric, annular grooves, the ball never contacts more than an arc-shaped segment of each groove. Therefore, the ball is gripped by a series of downwardly curving grooves which center the ball, the low point of which annular segments are in direct line with the direction of club swing and ball flight.

The golf club of the present invention is, by the nature of its construction, adapted for use by right or left handed golfers, the structure thereof further provides a universal lie. The weight of the bolt forming a part of the clamping means for holding the face portion in position is always directly behind the face of the club, thereby affording better control of the club when swung and enabling the ball to be hit with the maximum possible force. The structure of the disc-like face portion golf club further permits rotational movement thereof if the lower portion thereof becomes worn through use.

It is to be understood that the various movable face portions shown in the drawings may be interchangeably employed as desired. Furthermore, it is also within the contemplation of the present invention to provide a set of irons made substantially as set out in FIGS. 6, 7 and 8, but wherein the angularity of the face thereof is altered in the same manner as with conventional golf clubs.

While there has been herein shown and described the presently preferred forms of this invention, it is to be understood that such has been done for purposes of illustration only, and that various changes may be made thereto within the scope of the appended claims.

What is claimed is:

1. A golf club including:

a. a shaft, b. a club head comprising a hollow main body portion secured to said shaft, c. opposed end portions of said main body portion being cut away to provide a bore extending through said main body portion and the wall of said main body portion proximate the cut away portions being arcuate, d. said club head further including a movable disc-like portion having a front face comprising a ball-engaging surface and a rear concave face which complements, and is in slidable engagement with, the arcuate wall portion of said main body portion proximate the bore, e. a securing member extending from the rear face of said movable disc-like portion, f. a clamping member engaged with said movable disc-like portion, and g. a bolt member extending through said clamping member, the bore of the stationary main body portion for operative engagement with said securing member for holding said movable disc-like portion in a predetermined position.

2. The golf club of claim 1, wherein:

a. the diameter of said bolt member is substantially smaller than the diameter of the cut away portion of the main body portion, whereby said movable portion may be adjusted through an arc of 360° with respect to said stationary main body portion and the shaft.

3. The golf club of claim 1, wherein:

a. the striking face of said movable portion is provided with a plurality of annular grooves.

4. The golf club of claim 1, wherein:

a. the striking face of said movable portion is provided with a plurality of transverse ribs.

5. The golf club of claim 1, wherein:

a. said movable portion is of wedge shape.

6. A golf club including:

a. a shaft b. a club head attached to one end of said shaft, c. said club head including a stationary main body portion engaged with one end of the shaft, d. said main body portion having a bore extending therethrough and the outer wall of said body portion being arcuate proximate the bore, e. a movable portion having a ball-engaging face and a rear arcuate portion which complements, and is adapted for sliding engagement with, the arcuate wall of said main body portion, f. securing means extending through the bore of said main body portion, one end of which is engaged with the rear face of said movable portion, g. said securing means being substantially smaller than the bore through which it extends whereby said movable portion is adjustable through an arc of 360° to reposition the movable portion with respect to said stationary portion and said shaft, and h. clamping means engaged with the main body portion in opposed relation to said movable portion, i. the free end of said securing means being engaged with said clamping means.

7. The golf club of claim 6, with the addition of:

a. abrasive means between said main body portion and said movable portion, and between said main body portion and said clamping means, to prevent relative movement therebetween.

8. The golf club of claim 6, wherein a. said movable portion is of disc-like conformation, one face of which provides a ball-engaging surface and the opposite face slidably engages the arcuate part of said main body portion.

9. The golf club of claim 6, wherein a. the ball-engaging surface of said movable portion is substantially flat.

10. The golf club of claim 6, wherein a. the ball-engaging surface of said movable portion is concave

11. The golf club of claim 6, wherein a. said main body portion is hollow, b. weighting material, and c. means in said main body portion for permitting said weighting material to be added to the hollow body portion.

12. A golf club including:

a. a shaft b. a club head attached to one end of said shaft, c. said head including a stationary main body portion of spherical shape engaged with one end of the shaft, d. said spherical main body portion having a bore extending therethrough and the outer wall of the main body portion being arcuate proximate the bore, e. a movable portion having a ball-engaging face and a rear arcuate portion which complements, and is adapted for sliding engagement with, the arcuate wall of said main body portion, f. securing means extending through the bore of said spherical main body portion, one end of which is engaged with the rear face of said movable portion, g. clamping means having a rear arcuate portion which complements and is adapted for sliding engagement with, the arcuate wall of said main body portion, and i. securing means extending through the bore of said main body portion, one end of which is engaged with the rear face of said movable portion, j. the free end of said securing means being engaged with said clamping means, whereby said movable portion may be adjustably portioned with respect to said stationary portion.

13. The golf club of claim 12, with the addition of:

a. abrasive means between said clamping means and said spherical main body portion to prevent relative movement therebetween after said securing means has been tightened.

14. The golf club of claim 12, wherein:

a. said securing means is a bolt, the diameter of which is substantially smaller than the diameter of the bore extending through the main body portion, whereby said movable portion may be adjusted in any direction through an arc of 360° with respect to said stationary main body portion and the shaft.

15. The golf club of claim 12, wherein:

a. said movable body portion is of disc-like conformation.

16. The golf club of claim 12, wherein:

a. said ball-engaging surface of said movable portion is substantially flat.

17. The golf club of claim 12, wherein:

a. said ball-engaging surface of said movable portion is concave.

18. The golf club of claim 12, wherein:

a. said spherical main body portion is hollow, b. weighting material, and c. means in said spherical main body portion for permitting said weighting material to be added to the hollow body portion.

* * * * *